US008505917B2

(12) United States Patent
Richards, Jr.

(10) Patent No.: US 8,505,917 B2
(45) Date of Patent: Aug. 13, 2013

(54) BOARD GAME UTILIZING BINARY NUMBERS

(76) Inventor: Cleveland Haig Richards, Jr., Adelphi, MD (US)

( * ) Notice: Subject to any disclaimer, the term of this patent is extended or adjusted under 35 U.S.C. 154(b) by 0 days.

(21) Appl. No.: 13/316,702

(22) Filed: Dec. 12, 2011

(65) Prior Publication Data

US 2012/0153569 A1 Jun. 21, 2012

Related U.S. Application Data

(60) Provisional application No. 61/423,812, filed on Dec. 16, 2010.

(51) Int. Cl.
*A63F 3/00* (2006.01)

(52) U.S. Cl.
USPC ..... 273/237; 273/287

(58) Field of Classification Search
USPC ..... 273/236, 237
See application file for complete search history.

(56) References Cited

U.S. PATENT DOCUMENTS

| | | | | | |
|---|---|---|---|---|---|
| 3,420,526 | A | * | 1/1969 | Berger | 273/148 R |
| 3,663,021 | A | | 5/1972 | Whippo | |
| 3,677,549 | A | | 7/1972 | Moscovich | |
| 4,193,600 | A | * | 3/1980 | Armstrong et al. | 273/148 R |
| 4,327,920 | A | * | 5/1982 | Becker et al. | 273/238 |
| 4,455,025 | A | * | 6/1984 | Itkis | 273/237 |
| 5,007,648 | A | | 4/1991 | Polan | |

* cited by examiner

*Primary Examiner* — Vishu K. Mendiratta
(74) *Attorney, Agent, or Firm* — Bay State IP, LLC

(57) ABSTRACT

A board game incorporating binary conversions to entertain and educate players, comprising a multi-tiered playing field, a plurality of counters, of control pads, and playing cards. The playing field comprises a plurality of rooms, doors, roof hatches, and lights. Players enter the values from the playing cards into the control pads. The control pads electronically communicate with the counters to display the binary conversions. Based on the binary conversions, the lights on the playing field indicate which doors and roof hatches are opened or closed allowing players to navigate through the playing field. The winning player wins by being the first player to exit the playing field. It is contemplated that the board game can extend to computer games, video games, theme parks or other similar gaming opportunities wherein players can compete to navigate through and be the first to exit the playing field.

12 Claims, 5 Drawing Sheets

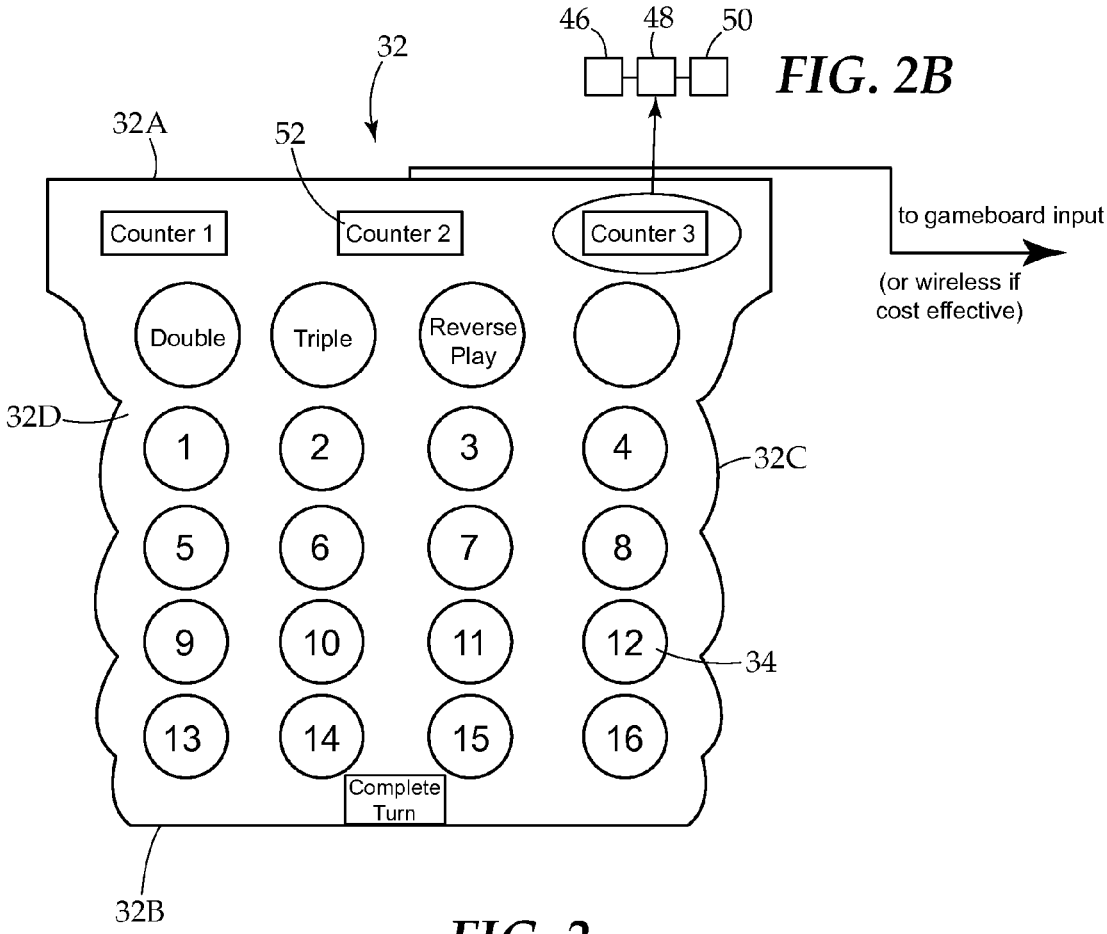
FIG. 2B
FIG. 2
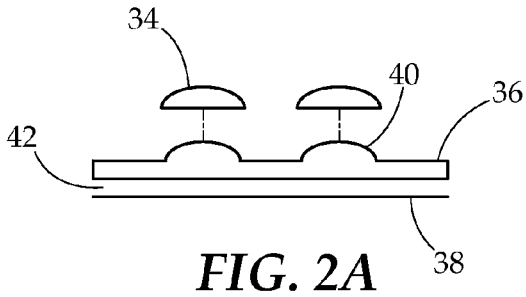
FIG. 2A

66

64

Binary Number Conversion Chart

| | | | | | | | | | | | | | | | | | | | |
|---|---|---|---|---|---|---|---|---|---|---|---|---|---|---|---|---|---|---|---|
| 0 | 00000000 | 37 | 00100101 | 74 | 01001010 | 111 | 01101111 | 148 | 10010100 | 185 | 10111001 | 222 | 11011110 |
| 1 | 00000001 | 38 | 00100110 | 75 | 01001011 | 112 | 01110000 | 149 | 10010101 | 186 | 10111010 | 223 | 11011111 |
| 2 | 00000010 | 39 | 00100111 | 76 | 01001100 | 113 | 01110001 | 150 | 10010110 | 187 | 10111011 | 224 | 11100000 |
| 3 | 00000011 | 40 | 00101000 | 77 | 01001101 | 114 | 01110010 | 151 | 10010111 | 188 | 10111100 | 225 | 11100001 |
| 4 | 00000100 | 41 | 00101001 | 78 | 01001110 | 115 | 01110011 | 152 | 10011000 | 189 | 10111101 | 226 | 11100010 |
| 5 | 00000101 | 42 | 00101010 | 79 | 01001111 | 116 | 01110100 | 153 | 10011001 | 190 | 10111110 | 227 | 11100011 |
| 6 | 00000110 | 43 | 00101011 | 80 | 01010000 | 117 | 01110101 | 154 | 10011010 | 191 | 10111111 | 228 | 11100100 |
| 7 | 00000111 | 44 | 00101100 | 81 | 01010001 | 118 | 01110110 | 155 | 10011011 | 192 | 11000000 | 229 | 11100101 |
| 8 | 00001000 | 45 | 00101101 | 82 | 01010010 | 119 | 01110111 | 156 | 10011100 | 193 | 11000001 | 230 | 11100110 |
| 9 | 00001001 | 46 | 00101110 | 83 | 01010011 | 120 | 01111000 | 157 | 10011101 | 194 | 11000010 | 231 | 11100111 |
| 10 | 00001010 | 47 | 00101111 | 84 | 01010100 | 121 | 01111001 | 158 | 10011110 | 195 | 11000011 | 232 | 11101000 |
| 11 | 00001011 | 48 | 00110000 | 85 | 01010101 | 122 | 01111010 | 159 | 10011111 | 196 | 11000100 | 233 | 11101001 |
| 12 | 00001100 | 49 | 00110001 | 86 | 01010110 | 123 | 01111011 | 160 | 10100000 | 197 | 11000101 | 234 | 11101010 |
| 13 | 00001101 | 50 | 00110010 | 87 | 01010111 | 124 | 01111100 | 161 | 10100001 | 198 | 11000110 | 235 | 11101011 |
| 14 | 00001110 | 51 | 00110011 | 88 | 01011000 | 125 | 01111101 | 162 | 10100010 | 199 | 11000111 | 236 | 11101100 |
| 15 | 00001111 | 52 | 00110100 | 89 | 01011001 | 126 | 01111110 | 163 | 10100011 | 200 | 11001000 | 237 | 11101101 |
| 16 | 00010000 | 53 | 00110101 | 90 | 01011010 | 127 | 01111111 | 164 | 10100100 | 201 | 11001001 | 238 | 11101110 |
| 17 | 00010001 | 54 | 00110110 | 91 | 01011011 | 128 | 10000000 | 165 | 10100101 | 202 | 11001010 | 239 | 11101111 |
| 18 | 00010010 | 55 | 00110111 | 92 | 01011100 | 129 | 10000001 | 166 | 10100110 | 203 | 11001011 | 240 | 11110000 |
| 19 | 00010011 | 56 | 00111000 | 93 | 01011101 | 130 | 10000010 | 167 | 10100111 | 204 | 11001100 | 241 | 11110001 |
| 20 | 00010100 | 57 | 00111001 | 94 | 01011110 | 131 | 10000011 | 168 | 10101000 | 205 | 11001101 | 242 | 11110010 |
| 21 | 00010101 | 58 | 00111010 | 95 | 01011111 | 132 | 10000100 | 169 | 10101001 | 206 | 11001110 | 243 | 11110011 |
| 22 | 00010110 | 59 | 00111011 | 96 | 01100000 | 133 | 10000101 | 170 | 10101010 | 207 | 11001111 | 244 | 11110100 |
| 23 | 00010111 | 60 | 00111100 | 97 | 01100001 | 134 | 10000110 | 171 | 10101011 | 208 | 11010000 | 245 | 11110101 |
| 24 | 00011000 | 61 | 00111101 | 98 | 01100010 | 135 | 10000111 | 172 | 10101100 | 209 | 11010001 | 246 | 11110110 |
| 25 | 00011001 | 62 | 00111110 | 99 | 01100011 | 136 | 10001000 | 173 | 10101101 | 210 | 11010010 | 247 | 11110111 |
| 26 | 00011010 | 63 | 00111111 | 100 | 01100100 | 137 | 10001001 | 174 | 10101110 | 211 | 11010011 | 248 | 11111000 |
| 27 | 00011011 | 64 | 01000000 | 101 | 01100101 | 138 | 10001010 | 175 | 10101111 | 212 | 11010100 | 249 | 11111001 |
| 28 | 00011100 | 65 | 01000001 | 102 | 01100110 | 139 | 10001011 | 176 | 10110000 | 213 | 11010101 | 250 | 11111010 |
| 29 | 00011101 | 66 | 01000010 | 103 | 01100111 | 140 | 10001100 | 177 | 10110001 | 214 | 11010110 | 251 | 11111011 |
| 30 | 00011110 | 67 | 01000011 | 104 | 01101000 | 141 | 10001101 | 178 | 10110010 | 215 | 11010111 | 252 | 11111100 |
| 31 | 00011111 | 68 | 01000100 | 105 | 01101001 | 142 | 10001110 | 179 | 10110011 | 216 | 11011000 | 253 | 11111101 |
| 32 | 00100000 | 69 | 01000101 | 106 | 01101010 | 143 | 10001111 | 180 | 10110100 | 217 | 11011001 | 254 | 11111110 |
| 33 | 00100001 | 70 | 01000110 | 107 | 01101011 | 144 | 10010000 | 181 | 10110101 | 218 | 11011010 | 255 | 11111111 |
| 34 | 00100010 | 71 | 01000111 | 108 | 01101100 | 145 | 10010001 | 182 | 10110110 | 219 | 11011011 | | |
| 35 | 00100011 | 72 | 01001000 | 109 | 01101101 | 146 | 10010010 | 183 | 10110111 | 220 | 11011100 | | |
| 36 | 00100100 | 73 | 01001001 | 110 | 01101110 | 147 | 10010011 | 184 | 10111000 | 221 | 11011101 | | |

*FIG. 3*

BOARD GAME UTILIZING BINARY NUMBERS

CROSS REFERENCE TO RELATED APPLICATION

This application claims the benefit of and takes priority from U.S. App. No. 61/423,812 filed on Dec. 16, 2010, the contents of which are hereby incorporated by reference.

BACKGROUND OF THE INVENTION

1. Field of the Invention

The invention relates to board games, and more specifically, a board game and method of play utilizing a multi-tiered playing field comprised of a plurality of rooms, doors, and roof hatches. The board game includes a plurality of counters which convert natural numbers to binary numbers and aid the players in navigating through the playing field and winning the board game by being the first player to exit the playing field.

People of all ages enjoy playing board games for both entertainment and educational value. Board games have traditionally offered a way for friends and families to bond and enjoy each other's company while simultaneously participating in a mutually entertaining activity. While video and computer gaming has gained in popularity, many families still turn to board games because board games are more affordable, last longer, and are family oriented.

However, there is a need for a board game which can bridge the gap between generations and keep pace with the technology of video and computer games. A board game using binary numbers helps bridge this gap by providing a means that appeals to all ages alike. The electronic aspects and three dimensional structure of the gaming apparatus appeals to the younger generation, while the strategy and premise appeal to the older generations. In addition, all players benefit from the educational usefulness of binary codes.

Board games are also revered for their ability to catalyze strategic thinking among players. Like Chess, a board game using binary numbers requires players to contemplate future moves in order to block opponents from proceeding in the game. Remembering the strategy and sequences of moves can also help support logical thinking and memory function, allowing the players to develop and improve skills while having fun.

In addition, board games can stimulate the player and help develop social skills. Board games require multiple player interactions, wherein each player has to work with or against other players. Board games further provide a forum for players to experience the effects of losing and winning, which is an invaluable experience for children and adults alike.

The current invention is a board game that employs the use of a three dimensional structure, binary numbers, and electronics to provide a forum for fun and educational growth, while appealing to a wide range of audiences. It is contemplated that the board game can extend to computer games, video games, theme parks or other similar gaming opportunities wherein players can compete to navigate through and be the first to exit the playing field.

2. Description of the Related Art

U.S. Pat. No. 3,663,021 to Whippo discloses a binary game apparatus consisting of a plurality of playing pieces each of which are identical and each of which has first and second distinguishing characters which are respectively assigned the numbers 0 and one comprising the numbers in the binary system having base 2. The playing pieces may be cards, and each card may have one white face representing the number 0 and an opposite black face representing the number 1. When such cards are arranged adjacent, those displaying upward the character representing the number 1 have the following values; the one farthest to the right has the value 1, the next to the left the value 2, the next to the left the value 4, the next to the left the value 8, and continuing if desired with each such card representing the binary number one placed next to the left doubling in value. The cards or other playing pieces displaying upward the character representing the number 0 have the value of 0 regardless of their position. The total value of a row of adjacent playing pieces is determined by adding together the values so represented by the displayed characters of each piece, whereby a variety of number games may be played.

U.S. Pat. No. 3,677,549 to Moscovich discloses a board game of educational value in familiarizing the player with the binary-system, comprises a playing board and a set of identically-shaped playing pieces, each playing piece having "n" (e.g. 4) equal sides and being divided into "n" equal parts. The parts of the playing pieces are colored in two distinctive colors providing $2^n$ possibilities of color-part combinations, each set including a playing piece for each of the $2^n$ color part combinations. The playing board includes markings dividing the board into a plurality of at least $2^n$ divisions, each division having an external shape identical to that of the playing pieces. Each playing piece represents a value in the binary-system of notation according to the position played on the board.

U.S. Pat. No. 5,007,648 to Polan discloses a game apparatus for two or more players, comprising a playing board having horizontal ranks and vertical rows forming an array of playing squares, with four sets of playing pieces, each set having distinct indicia disposed upon the front face of the playing pieces, with a border surrounding the array of playing squares on the playing board, and four distinct indicia similar to the indicia on the front face of the playing pieces disposed on the border of the playing board adjacent to each rank and row. There are at least as many playing pieces as there are playing squares in the array, with extra playing pieces withdrawn from play prior to the start of each game. Each player selects six playing pieces, and places one playing piece anywhere on the playing board, selecting a new playing piece from the drawing pile upon completion of each turn. Play alternates between players, until all the playing pieces have been played, without matching any indicia on any of the adjacent squares or adjacent border indicia. The winning player may receive points for each game won. Additional points may be awarded for each playing piece in the other player's hands upon completion of play. Bonus points may also be awarded for three or more identical indicia in each rank or row.

While these units may be suitable for the particular purpose employed, or for general use, they would not be as suitable for the purposes of the present invention as disclosed hereafter.

SUMMARY OF THE INVENTION

It is an object of the invention to provide a board game where the goal of each player is to navigate a multi-tiered playing field using binary number conversions. Accordingly, the present invention is a board game having a plurality of tiers, each tier having a plurality of rooms, doors, and roof hatches. A plurality of playing cards are utilized having natural numbers thereon and are converted to binary numbers through the use of a plurality of counters. The counters aid the player in revealing the doors and roof hatches that are opened during game play. The winning player wins the board game by being the first player to exit the playing field by moving through the opened doors and roof hatches.

It is another object of the invention to provide a board game that teaches players binary numbers in an entertaining and challenging environment. Accordingly, the present invention comprises a plurality of counters alongside the playing field that convert natural numbers to binary numbers in order to determine which doors and roof hatches are opened to allow players to move through the playing field.

It is another object of the invention to provide a board game which utilizes luck in order to entertain players. Accordingly, the present invention includes a plurality of playing cards which are shuffled and dealt to each player. Additionally, each player can choose whether to play with the playing cards face up or face down, the playing cards face down allows the players an added element of luck, such that the playing cards are flipped over on each turn to reveal which doors and roof hatches are opened within the playing field.

It is another object of the invention to provide a board game in which players must apply strategy to challenge other players in the game. Accordingly, the present invention allows players to choose to play with the playing cards face up for all to view, or face up but viewable only by the individual player owning the particular cards, thereby allowing the opportunity for a player to choose which playing cards to play each turn to alter the opened and closed doors and roof hatches to the benefit of that player. Additionally, players can choose to play one, two, or three playing cards each turn to further navigate through the playing field.

It is another object of the invention to provide a board game in which players may easily view all tiers of the playing field while seated anywhere around the board game. Accordingly, the present invention has four tiers, wherein the tiers are of varying heights and do not obstruct the view of any player, regardless of the position of the player around the board game.

It is another object of the invention to provide a multi-tiered board game that allows players to experience moving up within the playing field. Accordingly, the four tiers of the present invention are varying heights, which allow players to move through roof hatches in order to reach higher tiers of the playing field and exit the playing field to win the game.

It is another object of the invention to provide a board game that clearly indicates which doors and roof hatches are opened during each turn. Accordingly, the present invention includes lights that indicate which doors and roof hatches are opened and allow players to easily understand that they may move through any door or roof hatch with a light that is green, but may not move through any door or roof hatch with a light that is red.

It is another object of the invention to provide a board game which is easy for players of various ages to understand. Accordingly, the present invention simply requires players to play at least one playing card on each turn and to move through opened doors and roof hatches, as determined by the binary number conversion and indicated to the players by the lights on the board game.

It is another object of the invention to provide a board game in which game play may vary depending on the type of card played. Accordingly, the present invention provides "Fish My Wish" cards, "Double" cards, "Triple" cards, "Reverse Play" cards, "Roof Hatch" cards, and several sets of numbered cards. Each type of card can affect the value on the counters in a plurality of different ways.

It is another object of the invention to provide a board game that can engage even its most experienced players. Accordingly, the present invention provides variability in configuration by allowing the location of the hatches to change between games and during the course of play.

It is another object of the invention to provide a board game in which players may challenge one another as single players or teams. Accordingly, up to four players may play the board game of the present invention as individual opponents or multiple players as a team against other teams comprised of multiple players.

It is another object of the invention to provide a board game that is easily and inexpensively manufactured. Accordingly, the playing field of the present invention is made of hard plastics that are manufactured in a cost-effective and straightforward manner. Additionally, the electronic components of the board game are inexpensive and readily available.

It is another object of the invention to provide a board game that is of durable and reliable construction. Accordingly, the hard plastic material of the playing field of the present invention can withstand wear and tear over a long period of time.

It is another object of the invention to provide a board game that is capable of folding closed for ease of portability. Accordingly, the four tiers of the present invention are designed to fold over one another, allowing for easy storage and mobility.

It is another object of the invention to provide a board game in which the level of difficulty can increase according to the preference of the players. Accordingly, alternate embodiments of the present invention provide an extra challenge by having additional tiers, each tier including additional rooms, doors, and roof hatches for challenging the players to exit the playing field.

This invention is a board game incorporating binary conversions to entertain and educate players, comprising a multi-tiered playing field, a plurality of counters, control pads, and playing cards. The playing field comprises a plurality of rooms, doors, roof hatches, and lights. Players enter the values from the playing cards into the control pads. The control pads electronically communicate with the counters to display the binary conversions. Based on the binary conversions, the lights on the playing field indicate which doors and roof hatches are opened or closed allowing players to navigate through the playing field. The winning player wins by being the first player to exit the playing field. It is contemplated that the board game can extend to computer games, video games, theme parks or other similar gaming opportunities wherein players can compete to navigate through and be the first to exit the playing field.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

FIG. 2 is a detailed view of the control pads of the present invention.

FIG. 2A is a cross sectional view of the control pads illustrating the plurality of buttons, the membrane, and the keyboard sensor allowing for electrical contact with the keyboard sensor underneath the buttons when a key is pressed.

FIG. 2B is a block diagram of a counter shown on the control pad.

FIG. 3 is an exemplary table containing pairs of values, illustrating natural numbers and the corresponding conversion to binary numbers.

DETAILED DESCRIPTION OF THE PREFERRED EMBODIMENTS

Figure 1:
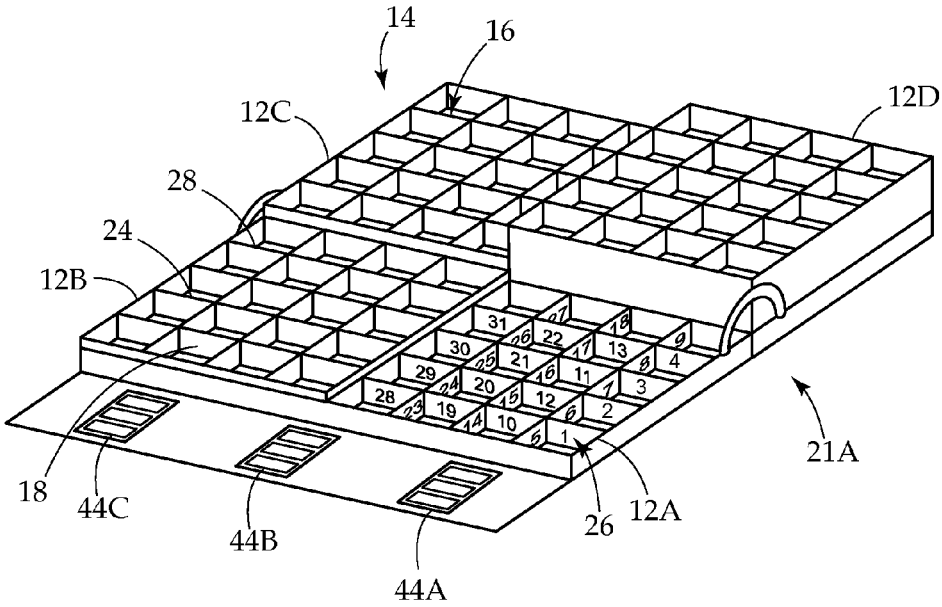
FIG. 1 is a diagrammatic perspective view of a board game of the present invention having a playing field with four tiers, three counters for converting natural numbers to binary numbers, and a plurality of control pads for relaying information inputted by a player to the counters.

Board games provide entertainment and educational value to people of all ages. Board games also provide a forum for friends and family members to bond through a shared, enjoyable experience. FIG. 1 illustrates a board game 10, wherein players navigate through a playing field 14 through doors 18 and roof hatches 20, which are opened or closed depending on correlating binary number conversions displayed on three counters 44. It is contemplated that the board game 10 can extend to computer games, video games, theme parks or other similar gaming opportunities wherein players can compete to navigate through and be the first to exit the playing field 14. In its broadest context, the board game 10 includes a playing field 14 having a plurality of tiers 12, a plurality of doors 18, a plurality of roof hatches 20, and a plurality of playing cards 30. The objective of the board game 10 is to win by being the first player to reach a roof hatch 20 on the fourth tier 12D and exit the playing field 14.

In the preferred embodiment, the playing field 14 of the board game 10 is made of hard plastics or other suitable material, and is substantially square. Preferably, the playing field 14 has four tiers 12 that extend upwardly to different elevations. The four tiers 12 are each substantially square and are flush adjacent each other when the playing field is ready for game play. Preferably, the first tier 12A is one inch high, the second tier 12B is two inches high, the third tier 12C is three inches high, and the fourth tier 12D is four inches high. The tiers 12 allow for players to advance in elevation throughout the playing field 14, simulating advancement to higher floors in a building. Alternate embodiments are contemplated wherein the playing field 14 has less than four tiers 12 or more than four tiers 12.

The board game 10 has an opened position 21A and a closed position 21B. FIG. 1 shows the board game 10 in the opened position 21A, wherein the board game 10 is ready for play. In the preferred embodiment, the board game 10 in the opened position 21A has a length of approximately nineteen inches, a width of approximately nineteen inches, and a height varying between one inch and four inches.

Figure 1A:
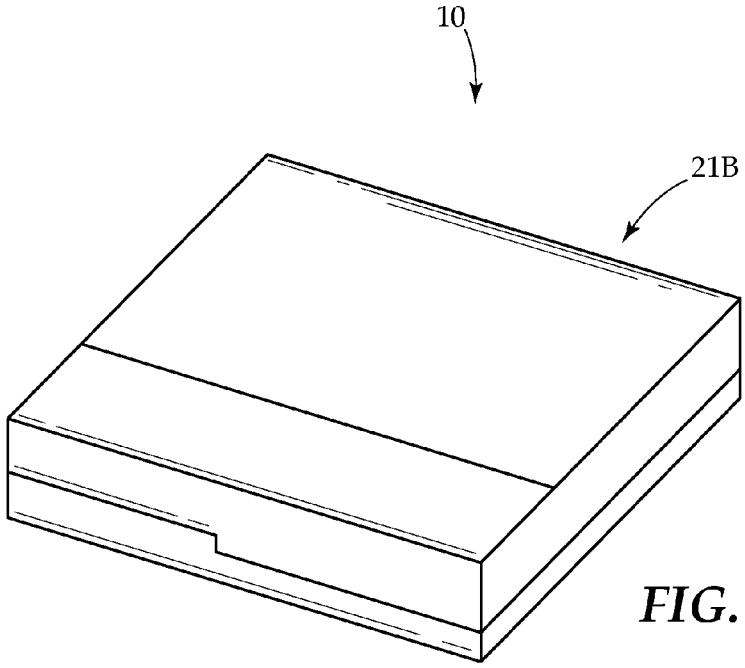
FIG. 1A is a diagrammatic perspective view of the board game of the present invention, wherein the playing field is in the closed position for easy storage and portability.

In the closed position 21B, shown in FIG. 1A, the board game 10 is folded for storage and easy mobility. Preferably, in the closed position 21B the board game 10 has a length of approximately nine and one-half inches, a width of approximately nineteen inches, and a thickness of approximately five inches.

As shown in FIG. 1, each tier 12 of the playing field 14 is comprised of a plurality of rooms 16. Preferably, each of the four tiers 12 contains twenty rooms 16, such that the playing field 14 comprises eighty rooms 16 total. The playing field 14 includes partitions 24, which divide each tier 12 into a grid configuration, thereby forming rooms 16 that are equally sized and substantially square. Each partition 24 represents a door 18 between each room 16 that players may move through. Preferably, the total number of doors 18 is one-hundred twenty-four, with thirty-one doors 18 on each tier 12 of the playing field 14.

Each tier 12 of the playing field 14 is further comprised of roof hatches 20 which allow players to advance to the next highest tier 12. Preferably, the roof hatches are located within a room 16 in the playing field. In the preferred embodiment, each tier 12 has a main roof hatch 20A, a first alternative roof hatch 20B, a second alternative roof hatch 20C, and a third alternative roof hatch 20D. The first tier 12A has a room 16 designated as the starting position 26. In alternate embodiments, it is contemplated that the number of roof hatches 20, and the room 16 the roof hatches 20 are positioned, may vary.

The playing field 14 of the board game 10 comprises lights 28 that change color and are integrally coupled to the playing field 14 to indicate to the players whether a door 18 or roof hatch 20 is opened or closed. A light 28 that is red indicates the door 18 or roof hatch 20 is closed. A light 28 that is green indicates the door 18 or roof hatch 20 is opened. The lights 28 are preferably light emitting diodes (LEDs). In the preferred embodiment, each light 28 corresponds to an individual door 18 or roof hatch of the playing field 14. Therefore, there are one-hundred and forty lights within the playing field 14. In the preferred embodiment, a light 28 that corresponds to a door 18 is positioned centrally on the respective partition 24. Lights 28 representing doors 18 alternate from a red color to a green color. Preferably, roof hatches 20 are designated within the playing field 14 by lights 28 centrally positioned within a room 16. Lights 28 representing roof hatches 20 alternate on and off with a yellow indicator light. When a light 28 that denotes a door 18 is green, the door 18 is opened and players are free to move through the door 18 towards a roof hatch 20. When a light 28 that denotes a roof hatch 20 is on with a yellow indicator, a player may advance to the next tier 12 upon entering the room 16 with the roof hatch 20.

Figure 1B:
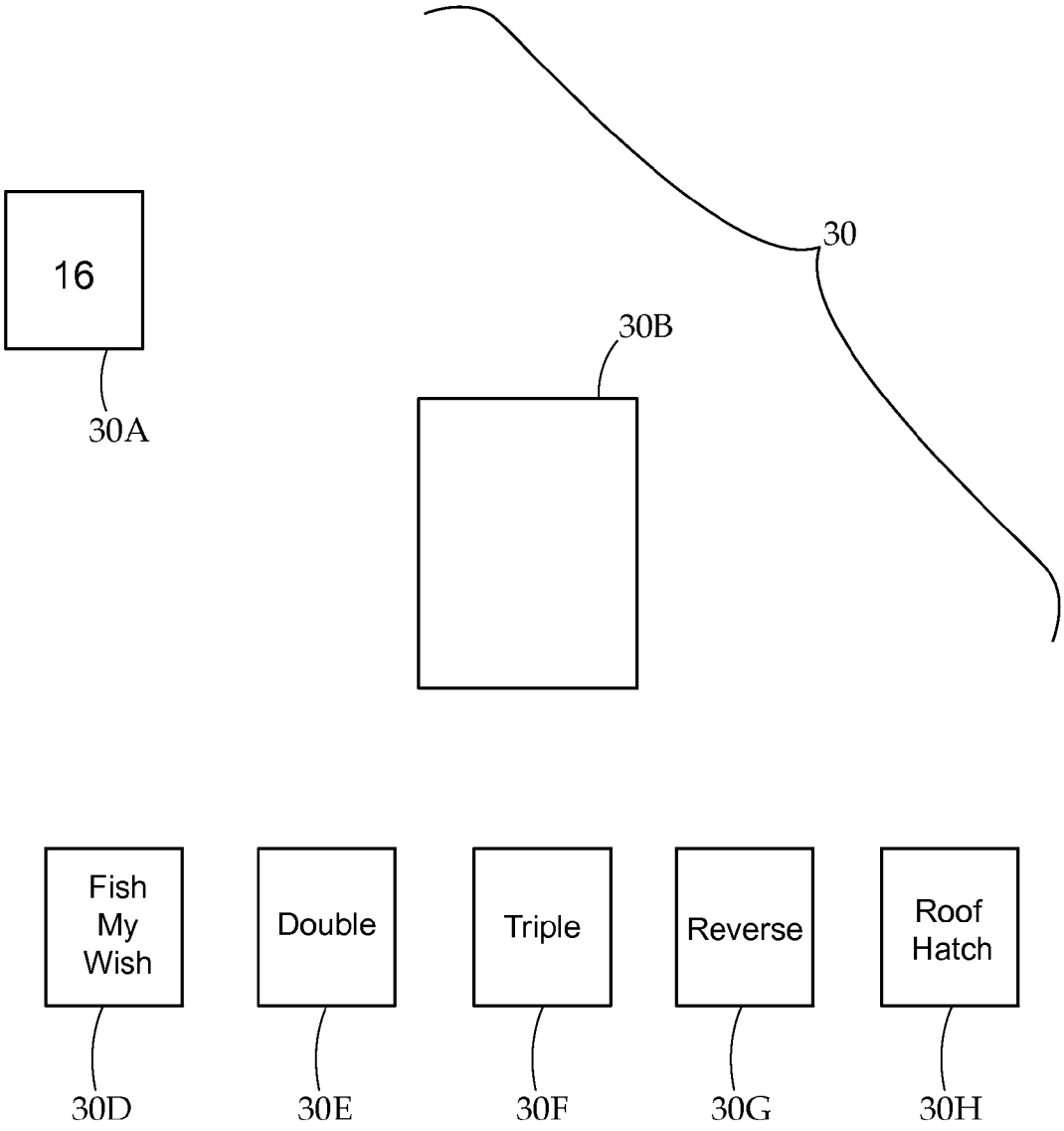
FIG. 1B is a top plan view of the playing cards, illustrating the numerical cards and the specials cards.

As shown in FIG. 1B, the board game 10 further contains a plurality of playing cards 30, preferably made of paper, plastic, or other suitable material. The playing cards 30 are used to add excitement and facilitate strategic thinking during game play. The playing cards 30 are further comprised of ninety-six numerical cards 30A and thirty-two special cards 30B, totaling one-hundred twenty-eight playing cards 30. The numerical cards 30A comprise six sets of playing cards 30 numbered "1" through "16". The special cards 30B include five "Fish My Wish" cards 30D, eight "Double" cards 30E, eight "Triple" cards 30F, six "Reverse Play" cards 30G, and five "Roof Hatch" cards 30H.

A plurality of dice (not shown) are included in the board game 10 and used to determine the order in which each player will play the board game 10. The dice are those commonly used in games, having six sides numbered one through six.

The control pads 32 of the board game 10 provide the players a means to electronically submit the numerical cards 30A or special cards 30B to the lights 28 of the playing field 14 to reveal which doors 18 and roof hatches are opened or closed. As shown in FIG. 2, the control pads 32 resemble traditional calculators that are well-known in the art. In the preferred embodiment, there are four control pads 32 comprised of hard plastics, having a top 32A, a bottom 32B, a right side 32C, and a left side 32D. Preferably, each control pad 32 is three-fourths inches thick, five inches across the top 32A, four inches across the bottom 32B, and five inches along the right 32C and left 32D sides. In the preferred embodiment, the control pads 32 are integrally coupled to the playing field 14 such that each player or team of players is provided with a personal control pad 32. The control pads 32 preferably communicate wirelessly with the board game 10; however, it is contemplated in alternate embodiments that the control pads 32 are wired to the playing field 14 through electronic means.

As shown in FIG. 2, the control pads 32 each comprise twenty-four keys 34, preferably made of plastic or other suitable material. Three keys 34 correspond to each of the three counters 44. Four keys 34 correspond to each special card 30B. Sixteen keys 34 correspond to the numbered playing cards 30. For example, a numerical card 30A that displays a "1" is represented on a key 34 of the control pad 32 as "1". To input information revealed on the playing card 30, a player first presses the corresponding key 34 on the control pad 32 for the counter 44 in which to alter the binary number 64 and then presses the corresponding key 34 for the displayed "1" from the numerical card 30A. A player presses the "Complete Turn" key to officially enter the count of each player's turn onto the counters 44.

As shown in FIG. 2A, the control pads 32 further comprise a membrane 36 and a keyboard sensor 38. The membrane 36 has a plurality of buttons 40 which are positioned directly underneath each key 34 and preferably made of rubber. There is a hollow space 42 underneath each button 40, such that when a player presses down a key 34, the button 40 located underneath also presses down, thereby making electrical contact with the keyboard sensor 38 underneath the buttons 40.

The board game 10 further comprises a plurality of counters 44. In the preferred embodiment, a first counter 44A, a second counter 44B, and a third counter 44C convert natural numbers 62 to binary numbers 64. The binary conversions of natural numbers 62, as shown in FIG. 3, dictate which doors 18 and roof hatches 20 are opened during each player's turn. Although the counters 44 are preferably wired into the playing field 14 through an electronic means, it is contemplated that in alternate embodiments, the counters 44 are external to and communicate wirelessly with the playing field 14.

The counters 44 of the board game 10 comprise transistors 46, a microchip processor 48, a circuit 50, and a display screen 52. The transistors 46 store binary numbers 64 determined by the keys 34 on the control pads 32 by switching electrical current on and off, such that switching current into the on position stores a one and switching current into the off position stores a zero. Once electrical contact is made with the keyboard sensor 38 underneath the rubber buttons 40 on the control pads 34, a microchip processor 48 determines which key 34 a player has pressed. A circuit 50 within the microchip processor 48 activates the display screen 52 corresponding to the keys 34 that are pressed. The display screen 52 shows binary numbers 64 which indicate through which doors 18 and roof hatches 20 players may move.

Figure 4:
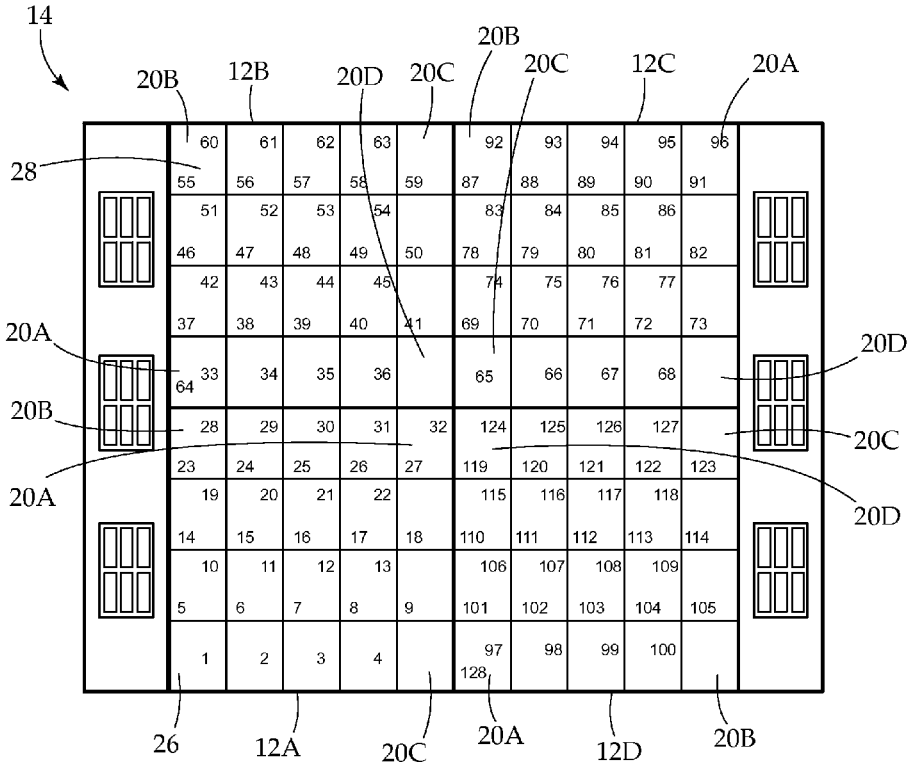
FIG. 4 is a top plan view of the playing field of the present invention, illustrating each tier having a plurality of rooms, doors, and roof hatches for allowing players to move through the playing field.
Figure 5:
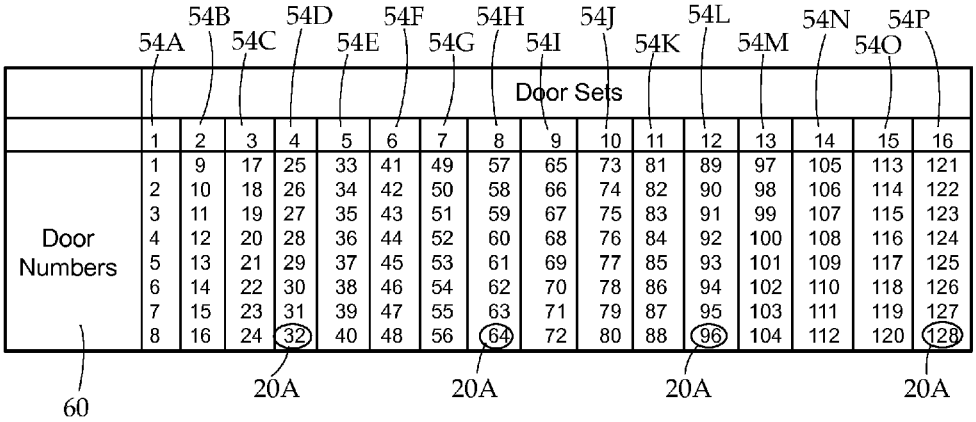
FIG. 5 illustrates an exemplary table containing the door set values of the present invention.

As shown in FIG. 4, each door 18 of the playing field 14 has a door number 60. Furthermore, as shown in FIG. 5, each door number 60 is assigned within a unique door set 54, allowing the counters 44 to indicate the specific doors 18 through which players may move.

In the preferred embodiment, the playing field 14 has sixteen door sets 54: a first door set 54A, a second door set 54B, a third door set 54C, a fourth door set 54D, a fifth door set 54E, a sixth door set 54F, a seventh door set 54G, an eighth door set 54*h*, a ninth door set 54I, a tenth door set 54J, an eleventh door set 54K, a twelfth door set 54L, a thirteenth door set 54M, a fourteenth door set 54N, a fifteenth door set 54O, and a sixteenth door set 54P. Preferably, each door set 54, comprises eight doors 18. The first door set 54A comprises door numbers 60 one through eight, the second door set 54B comprises door numbers 60 nine through sixteen, the third door set 54C comprises door numbers 60 seventeen through twenty-four, the fourth door set 54D comprises door numbers 60 twenty-five through thirty-two, the fifth door set 54E comprises door numbers 60 thirty-three through forty, the sixth door set 54F comprises door numbers 60 forty-one through forty-eight, the seventh door set 54G comprises door numbers 60 forty-nine through fifty-six, the eighth door set 54H comprises door numbers 60 fifty-seven through sixty-four, the ninth door set 54I comprises door numbers 60 sixty-five through seventy-two, the tenth door set 54J comprises door numbers 60 seventy-three through eighty, the eleventh door set 54K comprises door numbers eighty-one through eighty-eight, the twelfth door set 54L comprises door numbers 60 eighty-nine through ninety-six, the thirteenth door set 54M comprises door numbers 60 ninety-seven through one-hundred four, the fourteenth door set 54N comprises door numbers 60 one-hundred five through one-hundred twelve, the fifteenth door set 54O comprises door numbers 60 one-hundred thirteen through one-hundred twenty, and the sixteenth door set 54P comprises door numbers 60 one-hundred twenty-one through one-hundred twenty-eight. To allow for further variation during game play, the eighth door 18 of door sets four 54D, eight 54H, twelve 54L and sixteen 54P are the main roof hatches 20A for first tier 14A, second tier 14B, third tier 14C, and fourth tier 14D, respectively. Therefore the status of the main roof hatches 20A will change in a similar manner as all doors 18 within the playing field 14.

The first counter 44A, second counter 44B, and third counter 44C display binary numbers 64 which are necessary to determine which doors 18 and roof hatches 20 within the playing field 14 are opened and closed. The binary numbers 64 are comprised of digits 66 where each digit 66 indicates if a door 18 follows the switching pattern from opened or closed. A digit 66 of "1" indicates that the door number 60 is opened, and a digit 66 of "0" indicates that the door number 60 is closed.

The first counter 44A displays binary numbers 64 that introduce the switching command of any eight given doors 18. The binary number 64 displayed on the second counter 44B indicates which doors 18 from door sets one 54A, two 54B, three 54C, four 54D, five 54E, six 54F, seven 54G, and eight 54H will alter based on the binary number 64 from the first counter 44A. The binary number 64 displayed on the third counter 44C indicates which doors 18 from door sets nine 54I, ten 54J, eleven 54K, twelve 54L, thirteen 54M, fourteen 54N, fifteen 54O, and sixteen 54P will alter based on the binary number 64 from the first counter 44A. For example, if during the course of game play, the first counter 44A displays binary number 64 for the number "73" which is 01001001, and the second counter displays the binary number 64 for the number "40" which is 00101000, and the third counter displays the binary number 64 for number "36" which is 00100100, then the third, fifth, eleventh and fourteenth door sets 54 will be affected based on the second 44B and third counter 44C. Based on the first counter 44A the doors 18 in the second, fifth and eighth position of the door set 54 will open and remaining doors 18 within the playing field 14 will close as indicated by the lights 28 for each respective door 18. Therefore, door numbers 18, 21, 24, 34, 37, 40, 82, 85, 88, 106, 109, and 112 will be opened and indicated as such with a light 28 that is green. All remaining doors 18 within the playing field 14 will be closed with a light 28 that is red.

The counters 44 maintain a count from "0" to "255" and also display the respective binary number 64. The counters 44 are cumulative adding upon the last numerical card 30A played until reaching "255" wherein each individual counter resets to "0". For example, if player one plays a number "10" as the first playing card 30 during the turn, the first counter 44A displays the binary number 64 associated with "10". If player two then plays a number "16" as first card during the turn, the first counter 44A adds the "10" and "16" to equal "26." Thus, the first counter 44A shows the binary number 64 for "26," and the corresponding doors 18 for the binary number 64 for "26" are affected. The second counter 44B and the third counter 44C mirror the first counter's 44A functioning in the aforementioned way.

The board game 10 further comprises a master control panel 56 that maintains the status of all three counters 44. If the value on any counter 44 reaches two-hundred and fifty-five during the game, the master control panel 56 sets the counter 44 back to zero so that the counter 44 counts up toward two-hundred and fifty-five again allowing game play to continue and doors and 18 roof hatches 20 to alter from opened to closed.

Method of Play

To win the board game 10, the players must utilize a combination of skill and luck to navigate through the playing field 14 in order to be the first player to exit the playing field 14 through a roof hatch 20 on the fourth tier 12D. To navigate through the playing field 14, the players enter rooms 16 through doors 18 that are opened, as indicated by a light 28 that is green.

In the preferred embodiment, there are twenty rooms 16 on each of the four tiers 12 of the playing field 14 for the players to navigate through. Preferably, each tier 12 has a main roof hatch 20A, a first alternative roof hatch 20B, a second alternative roof hatch 20C, and a third alternative roof hatch 20D. The first tier 12A has a room 16 that is the starting position 26 for all the players.

The roof hatches 20 allow the player to move to the next highest tier 12 in the playing field 14 to eventually reach a roof hatch 20 on the fourth tier 12D. The players may only advance to the next highest tier 12 if the door 18 of the room 16 in which the roof hatch 20 is located is opened and the particular roof hatch 20 is also opened and available for game play. Thus, the player must utilize strategy to effectively advance through the rooms 16 and reach an opened roof hatch 20 in order to eventually reach the fourth tier 12D. Once reaching the fourth tier 12D, a player can exit the playing field 14 using a roof hatch 20 that is opened, effectively winning the game.

The board game 10 is suitable for up to four players, with the option of individual or team play. Before game play begins, the players must first determine the game play order and distribute all the appropriate playing cards 30. To establish game play order, each player must first roll the dice in turn. The player with the highest roll is player one for game play order, followed by the player with the second highest role. This pattern continues until all players are accounted for.

The playing cards 30 of the board game 10 are collectively comprised of numerical cards 30A and special cards 30B, totaling one-hundred and twenty-eight playing cards 30. Each numerical card 30A has a printed number from "1" to "16" located thereon. The special cards 30B are further comprised of five "Fish My Wish" cards 30D, eight "Double cards" 30E, eight "Triple cards" 30F, six "Reverse Play" cards 30G, and five "Roof Hatch" cards 30H, which the players can employ to fluctuate game play. To distribute the playing cards 30, one player shuffles all the playing cards 30 collectively and hands each player thirty-two of these shuffled playing cards 30 face-down. During game play with less than four players, the remaining playing cards 30 are kept aside until the playing cards 30 are reshuffled and redistributed to all players. Alternatively, with less than four players, the remaining playing cards 30 are placed in a collective pile that players can also choose to play from during each turn. Each player decides if the playing cards 30 will be viewable to all players throughout the game play or if the playing cards will remain face down. Allowing all players to see the playing cards 30 will add an extra element of strategy, while not seeing the playing cards 30 will add an element of mystery and luck. During game play, the entire deck of one-hundred and twenty-eight playing cards 30 are reshuffled and redistributed once any one player has depleted all thirty-two of their playing cards 30. To further strategize, players have a choice of playing one, two, or three playing cards 30 during game play to gain further opportunities to navigate through the playing field 14. While players may choose to play one, two, or three playing cards 30, only one playing card is entered on each counter 44. Therefore, once a player plays the first playing card 30, the player may choose if the first playing card 30 played will affect the first counter 44A, second counter 44B, or third counter 44C. Similarly, when the player plays a second playing card, the player may choose which counter 44 to affect, but may not choose the counter 44 in which the first playing card 30 was entered. For example, if a player chooses to enter the first playing card 30 played into the second counter 44B, the next playing card 30 played may only affect the first 44A or third counter 44C. The counters 44 show the potential binary number 64 which will display on the counter 44, however, the binary numbers 64 will not change until the player presses the "Complete Turn" key 34 on the control pad 32. This variability enables a player to change the status of each counter 44 with each turn during game play.

The varying combination of opened roof hatches 20 allows for more varied and exciting game play. The eighth door 18 of door sets four 54D, eight 54H, twelve 54L and sixteen 54P are the main roof hatches 20A for first, second, third and fourth tiers 14, respectively. Therefore door numbers 32, 64, 96, and 128, representing the roof hatches, are subject to the same switching pattern as all the doors 18 in the playing field 14. Additionally, only one roof hatch 20 is opened on each tier 12 at any time during game play. At the start of game play, all main roof hatches 20A are opened. "Roof Hatch" 30H cards are utilized by a player to affect the roof hatches 20 during a player's turn. "Roof Hatch" 30H cards affect the roof hatches 20 by adding the first four digits 66 of the binary number 64 on the second counter 44B to affect which roof hatch 20 is opened on the first tier 12A. Similarly, adding the last four digits 66 of the binary number 64 on the second counter 44B will affect the roof hatches 20 of the second tier 12B, the first four digits 66 of the binary number 64 on third counter 44C will affect the roof hatches 20 of the third tier 12C, and the last four digits 66 of the binary number 64 on the third counter 44C will affect the roof hatches 20 of fourth tier 14D. "Roof Hatch" cards 30H are only available for game play once all players move from the starting position 26. When a "Roof Hatch" card is played the roof hatches 20 within the playing field 14 are affected as follows: if any four digits 66 of the binary number 64 add to 0, all roof hatches 20 remained closed for the respective tier 12, if the four digits 66 add to 1, the main roof hatch 20A within the respective tier 12 is opened, if the four digits add to 2, the first alternate roof hatch 20B within the respective tier 12 is opened, if the four digits add to 3, the second alternate roof hatch 20C within the respective tier 12 is opened, if the four digits add to four, the third alternate roof hatch 20D within the respective tier 14 is opened. For example if a player plays a "Roof Hatch" card 30H and if the second counter 44B displayed the binary number 64 for "43" which is "00101100" then the main roof hatch 20A on the first tier 12A is opened and the remaining roof hatches 20 on the first tier 12A are closed. Similarly, the first alternate roof hatch 20B is opened on the second tier 12B. This same pattern will affect the roof hatches 20 on the third tier 12C and fourth tier 12D based on the binary number 64 displayed on the third counter 44C.

The playing cards 30 relate to the first counter 44A, second counter 44B, and the third counter 44C that act to alter the lights 28 being turned green, red, or yellow thereby indicating if a particular door 18 or roof hatch 20 is opened or closed within the playing field 14. As mentioned supra, the first counter 44A displays binary numbers 64 that introduce the switching command of any eight given doors 18. The binary number 64 displayed on the second counter 44B indicates which doors 18 from door sets one 54A, two 54B, three 54C, four 54D, five 54E, six 54F, seven 54G, and eight 54H will alter based on the binary number 64 from the first counter 44A. The binary number 64 displayed on the third counter 44C indicates which doors 18 from door sets nine 54I, ten 54J, eleven 54K, twelve 54L, thirteen 54M, fourteen 54N, fifteen 54O, and sixteen 54P will alter based on the binary number 64 from the first counter 44A.

To move through the playing field 14, the players, in turn, play one, two, or three playing cards 30. Each player or team of players has a control pad 32, wherein the player enters the corresponding key 34 on the control pad 32 relating to the playing card 30 played. If a player plays a numerical card 30A as the first card, and chooses to affect the first counter 44A, the player presses the corresponding key 34 on the control pad 32, for the first counter 44A. The first counter 44A then displays a binary number 64 comprised of eight digits 66 used to determine which of the doors 18 are affected by the switching command. When a player chooses to play a second playing card 30 and plays a numerical card 30A, and chooses to affect the second counter 44B, the player presses the corresponding key 34 on the control pad 32 which relays the information to the second counter 44B. The second counter 44B then displays the binary number 64 corresponding with the second playing card 30 played. The second counter 44B indicates which door set from door sets one through eight are affected as a digit of "1". When a player chooses to play a third playing card 30 and plays a numerical card 30A, the player presses the corresponding key 34 on the control pad 32 which relays the information to the third counter 44C. The third counter 44C then displays the binary number 64 corresponding with the third playing card 30 played. The third counter 44C indicates which door set from door sets nine through sixteen are affected as a digit of "1". Once a player has chosen to play one, two, or three cards and affect the counters 44, doors 18 and roof hatches 20, the player presses the "Complete Turn" key 34 and all binary numbers 64 displayed are entered and all lights 28 on the playing field 14 will alter based on the binary numbers 64 displayed.

The counters 44 are cumulative adding upon the last numerical card 30A played until reaching "255" wherein each individual counter 44 resets to "0". For example, if player one plays a number "10" as the first playing card 30 and chooses to use the first playing card 30 on the first counter 44A, the player presses the corresponding key 34 on the control pad 32 for the first counter 44A and the presses the corresponding key 34 for the number "10". The first counter 44A then displays the binary number 64 associated with "10". If player two then plays a number "16" as the next playing card 30 and also chooses to use this number "16" on the first counter 44A, player two presses the corresponding key 34 on the control pad 32 for the first counter 44A, and then presses the corresponding key 34 for "16". The first counter 44A adds the "10" and "16" to equal "26." Thus, the first counter 44A shows the binary number 64 for "26". The second counter 44B and the third counter 44C mirror the first counter's 44A functioning in the aforementioned way.

In addition to numerical cards 30A, players may also play special cards 30B which add variety and excitement to the board game 10. Each of the special cards 30B also has a corresponding key 34 on the control pads 32. If a "Fish My Wish" card 30D is played, the player can choose any number from "0" to "16" and press the corresponding key 34 on the control pad 32. The choice of which number to press and therefore alter the doors 18 which open provides the player the potential to utilize strategic thinking in order to advance in the board game 10 by choosing a number that will yield favorable results to navigate through the playing field 14.

If a "Double" card 30E is played, the player presses the corresponding key 34 on the control pad 32, which essentially doubles the previous natural number 62. For example, if the first counter 44A displays the binary number 64 associated with the natural number 62 "60" and the player one presses the corresponding key 34 for a "Double" card 30E on the control pad 32, the first counter 44A will then display the binary number 64 associated with the natural number 62 "120." Similar to the "Double" card 30E, if a "Triple" card 30F is played, the player presses the corresponding key 34 on the control pad 32 which triples the previous natural number 62. Similar to numerical cards, "Double" 30E or "Triple" 30F cards affect one counter 44 at a time, therefore, the player must decide which counter 44 to affect and press the corresponding key 34 for the counter 44 before pressing the corresponding key 34 for either the "Double" card 30E or "Triple" 30F card.

"Reverse Play" cards 30G return all three counters 44 to the binary numbers 64 that each counter 44 displayed prior to the previous player's play. The "Roof Hatch" cards 30H affect which alternative roof hatch is altered as mentioned supra.

Each player has a playing piece (not shown) to represent the location of the player within the playing field 14. During game play, each player may move the playing piece within the playing field 14 up to two times per turn. A player may move once before the first card on the players turn is played to take advantage of opened doors 18 and roof hatches 20 from the previous turn. A player may move once again after the entirety of the player's turn thereby taking advantage of the player's turn on the counters 44, doors 18, and roof hatches 20.

In conclusion, herein is presented a board game. The invention is illustrated by example in the playing figures, and throughout the written description. It should be understood that numerous variations are possible, while adhering to the inventive concept. Such variations are contemplated as being a part of the present invention.

What is claimed is:

1. A board game comprising:

a playing field, wherein the playing field further comprises:

a plurality of tiers, wherein each tier further comprises:

a plurality of partitions, wherein the plurality of partitions divide each tier into a plurality of rooms, and wherein each room further comprises a plurality of doors; and a plurality of rooms designated to contain roof hatches, wherein each roof hatch allows for movement between the tiers;

a plurality of counters, wherein each counter further comprises:

a plurality of transistors adapted to store a binary number from the control pad;

a microchip processor adapted to convert a plurality of natural numbers into binary numbers;

a circuit, wherein the circuit is located within the microchip processor; and a display screen, wherein the display screen is disposed to be activated by the circuit showing the binary number;

a plurality of playing cards; and a plurality of control pads wherein the plurality of control pads is in electric communication with the counters and playing field.

2. The board game of claim 1, wherein the playing field further comprises four tiers, wherein each tier extends upwardly to a different elevation in relation to an adjacent tier, thereby allowing for a player to advance in elevation throughout the playing field.

3. The board game of claim 1, wherein each tier further comprises:

a main roof hatch;

a first alternative roof hatch;

a second alternative roof hatch; and a third alternative roof hatch.

4. The board game of claim 1, wherein the binary number displayed on the counters indicates the doors and roof hatches possessing an open position on the playing field, and the doors and roof hatches possessing a closed position on the playing field.

5. The board game of claim 1, wherein each door further comprises a corresponding light to indicate an open position of the door based on the type of illumination, and wherein each roof hatch further comprises a corresponding light to indicate an open position of the roof hatch based on the type of illumination.

6. The board game of claim 5, wherein each light is selected from a group consisting of light emitting diodes.

7. The board game of claim 5, wherein an illumination of a green light indicates the open position of a corresponding door, wherein an illumination of a red light indicates the closed position of a corresponding door, and wherein an illumination of a yellow light indicates the open position of a corresponding roof hatch.

8. The board game of claim 1, wherein the playing cards further comprise:

a plurality of numerical cards displaying a natural number ranging in value from one to sixteen; and a plurality of special cards.

9. The board game of claim 8, wherein the special cards further comprise:

a first card, wherein the first card allows for a choice of the natural number of numerical cards;

a second card, wherein the second card is disposed to double the natural number on a selected counter;

a third card, wherein the third card is disposed to triple the natural number on a selected counter;

a fourth card, wherein the fourth card is disposed to reverse the previous player's play thus returning all three counters to the binary numbers that existed on them prior to the previous player's play; and a fifth card, wherein the fifth card is disposed to alter the open position of the plurality of roof hatches determined by the binary number on the selected numerical card.

10. The board game of claim 1, wherein each control pad further comprises:

a membrane, wherein the membrane comprises a plurality of buttons;

a keyboard sensor; and a hollow space located between the membrane and the keyboard sensor.

11. The board game of claim 1, wherein the playing field is disposed to collapse into a closed position.

12. A board game comprising:

a playing field, wherein the playing field further comprises:

four tiers, wherein each tier extends upwardly to a different elevation in relation to an adjacent tier, thereby allowing for a player to advance in elevation throughout the playing field, and wherein each tier further comprises:

a plurality of partitions disposed to divide each tier into a plurality of rooms, and wherein each room further comprises a plurality of doors;

a plurality of rooms designated to contain roof hatches, wherein each roof hatch allows for movement between the tiers;

a plurality of counters, wherein each counter further comprises:

a plurality of transistors adapted to store a binary number from the control pad;

a microchip processor adapted to convert a plurality of natural numbers into binary numbers;

a circuit, wherein the circuit is located within the microchip processor; and a display screen, wherein the display screen is disposed to be activated by the circuit showing the binary number;

a plurality of playing cards, wherein the playing cards further comprise:

a plurality of numerical cards displaying a natural number ranging in value from one to sixteen;

a plurality of special cards, wherein the plurality of special cards further comprises:

a first card, wherein the first card allows a choice of the natural number of the numerical cards;

a second card, wherein the second card is disposed to double the natural number on a selected numerical card;

a third card, wherein the third card is disposed to triple the natural number on a selected numerical card;

a fourth card, wherein the fourth card is disposed to reverse the previous player's play thus returning all three counters to the binary numbers that existed on them prior to the previous player's play;

a fifth card, wherein the fifth card is disposed to alter the open position of the plurality of roof hatches determined by the binary number on the selected numerical card;

a plurality of control pads wherein each control pad is in electric communication with the counters and playing field and further comprises:

a membrane, wherein the membrane comprises a plurality of buttons;

a keyboard sensor; and a hollow space located between the membrane and the keyboard sensors; and a plurality of lights corresponding to the open position and the closed position in relation to the plurality of doors and the plurality of roof hatches.

* * * * *